US005764269A

United States Patent [19]

Takeshita et al.

[11] Patent Number: 5,764,269

[45] Date of Patent: Jun. 9, 1998

[54] ELECTROPHOTOGRAPHIC APPARATUS WITH OPTICAL SCANNING UNIT PIVOTABLE IN HORIZONTAL PLANE

[75] Inventors: Masami Takeshita; Toshitaka Ogawa; Masao Miyasaka; Kazuo Sugano, all of Ibaraki, Japan

[73] Assignee: Hitachi Koki Co., Ltd., Tokyo, Japan

[21] Appl. No.: 416,979

[22] Filed: Apr. 5, 1995

[30] Foreign Application Priority Data

Apr. 8, 1994 [JP] Japan ..... 6-070971
Mar. 17, 1995 [JP] Japan ..... 7-058662

[51] Int. Cl.[6] ..... P41J 2/47

[52] U.S. Cl. ..... 347/233; 347/242; 347/257

[58] Field of Search ..... 347/241, 242, 347/256, 257

[56] References Cited

U.S. PATENT DOCUMENTS 4,297,713 10/1981 Ichikawa et al. ..... 347/257
5,309,182 5/1994 Mama et al. ..... 347/157

FOREIGN PATENT DOCUMENTS 62-193240 12/1987 Japan ..... G03G 15/00

*Primary Examiner*—Mark J. Reinhart
*Attorney, Agent, or Firm*—Sughrue, Mion, Zinn, Macpeak & Seas, PLLC

[57] ABSTRACT

An electrophotographic apparatus having an image carrying and an optical scanning unit, wherein an optical scanning unit support means is provided, the optical scanning unit support means serving to turn the optical scanning unit in a horizontal direction, so that an error in positioning the image carrying body with respect to the optical scanning unit can be corrected by the turning operation.

16 Claims, 2 Drawing Sheets

ELECTROPHOTOGRAPHIC APPARATUS WITH OPTICAL SCANNING UNIT PIVOTABLE IN HORIZONTAL PLANE

BACKGROUND OF THE INVENTION

1. Field of the Invention

The invention relates to electrophotographic apparatuses and, more particularly to an electrophotographic apparatus having means for correcting an error in positional relationship between an optical scanning unit and an apparatus main body, which have separately been pre-assembled.

2. Description of the Related Art

One structure of an electrophotographic apparatus is such that a beam of light corresponding to an image signal is scanned by a laser beam optical scanning system onto a photosensitive drum serving as an image carrying body; a latent electrostatic image formed on the photosensitive drum is developed by a known electrophotographic process; and the developed image is transferred and outputted to a recording medium such as paper.

Recording using a laser beam requires high accuracies. If a correct positional relationship between the image carrying body and the optical scanning unit is not present due to inconsistency in the accuracy of parts forming the optical scanning unit itself, the accuracy of the support members on an apparatus main body side on which the optical scanning unit is mounted, the accuracy of the image carrying body itself, the accuracy of the support members on the main body side on which the image carrying body is mounted, and the like, then the problem of forming distorted images is encountered.

To overcome the aforementioned problem, various proposals have been made to provide an electrophotographic apparatus having means for correcting positional error between the apparatus main body and the optical scanning unit. The majority of such proposals require a lot of time and labor are therefore unsatisfactory in assembling efficiency. That is, as is disclosed, e.g., in Japanese Utility Model Unexamined Publication No. Sho. 62-193240, a plurality of positioning bolt members are arranged in the optical scanning unit, and the height of the optical scanning unit is adjusted by adjusting the respective bolt members until a height of the optical scanning unit for eliminating the inclination of the scanning line on the image carrying body can be found. The adjustment of the plurality of bolt members entails much time and labor.

In addition, in the case where the optical scanning unit in use must be replaced with a new one due to an abnormality of the apparatus at the site of a customer, then an error in positioning the optical scanning unit with respect to the apparatus main body must be readjusted for every replacement because the error correction means is provided on the side of the optical scanning unit in the aforementioned conventional apparatus. This has made the conventional apparatus also unsatisfactory in maintainability.

Moreover, along with the downsizing of electrophotographic apparatuses, many types of electrophotographic apparatuses use press-worked sheet metal to make their frame. The frame made of sheet metal is advantageous in reducing weight, but is not rigid enough to support the apparatus with accuracy. For example, in the case of an electrophotographic apparatus in which the image carrying body and the optical scanning unit are supported by the frame, the scanning line for scanning the image carrying body is inclined with respect to a desired scanning line, which producing unsatisfactory images.

SUMMARY OF THE INVENTION

The present invention has been made in view of the foregoing problems with the conventional apparatus, and therefore an object of the invention is to provide an electrophotographic apparatus which require little time and labor for adjusting the optical scanning unit.

Another object of the invention is to provide an electrophotographic apparatus requiring no readjustment of an error in positioning the optical canning unit with respect to the apparatus main body at the time of replacing the old optical scanning unit with a new one.

Still another object of the invention is to improve the reliability of an electrophotographic apparatus having a frame made of sheet metal.

To achieve the above objects, the invention is applied to an electrophotographic apparatus having an image carrying body and an optical scanning unit, in which optical scanning unit support means is provided, the optical scanning unit support means serving to turn the optical scanning unit in a horizontal direction, so that an error in positioning the image carrying body with respect to the optical scanning unit can be corrected by the turning operation.

According to the invention, the optical scanning unit and the apparatus main body are assembled and adjusted separately in advance so that individual optical scanning units are completely interchangeable. Therefore, the optical scanning units can be replaced without readjustment once the optical scanning unit has been positioned with respect to the apparatus main body at an initial stage after it is delivered from the factory.

The above and other objects and features of the present invention will be more apparent from the following description taken in conjunction with the accompanying drawings.

DETAILED DESCRIPTION OF THE PREFERRED EMBODIMENT

An embodiment of the invention will now be described with reference to FIGS. 1 to 3.

Figure 1:
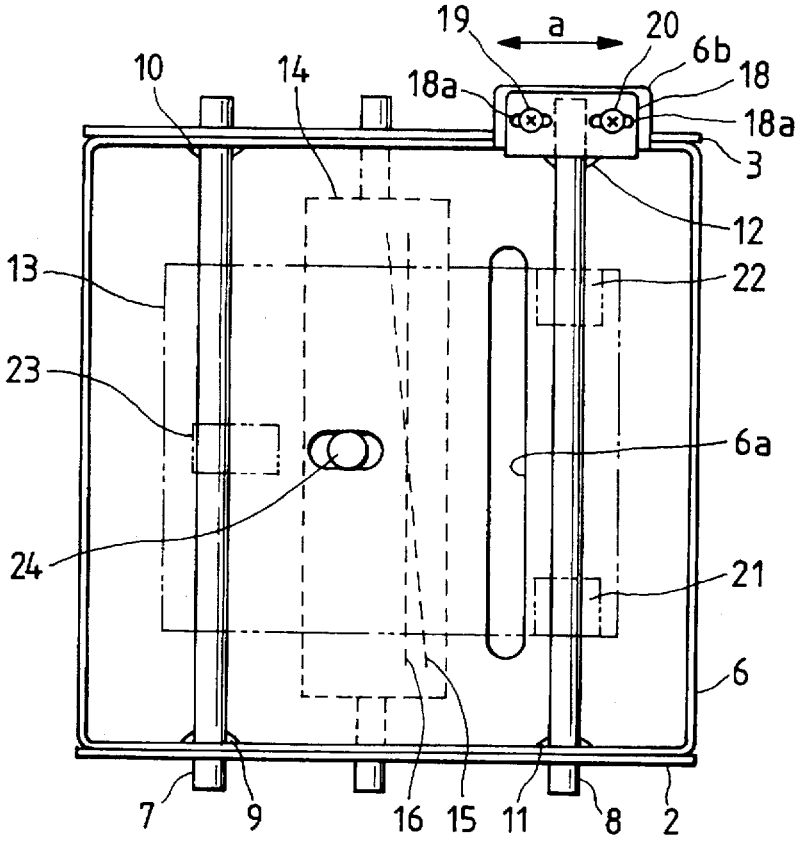
FIG. 1 is a plan view of an electrophotographic apparatus of the invention.
Figure 2:
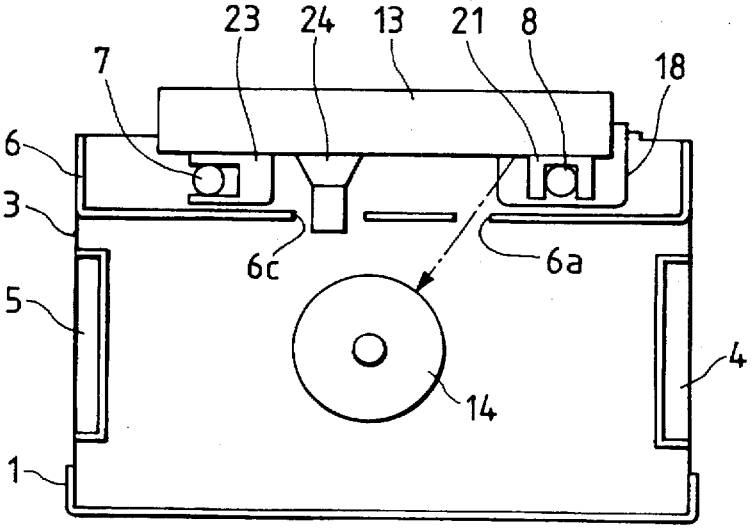
FIG. 2 is a front view of the electrophotographic apparatus of the invention.
Figure 3:
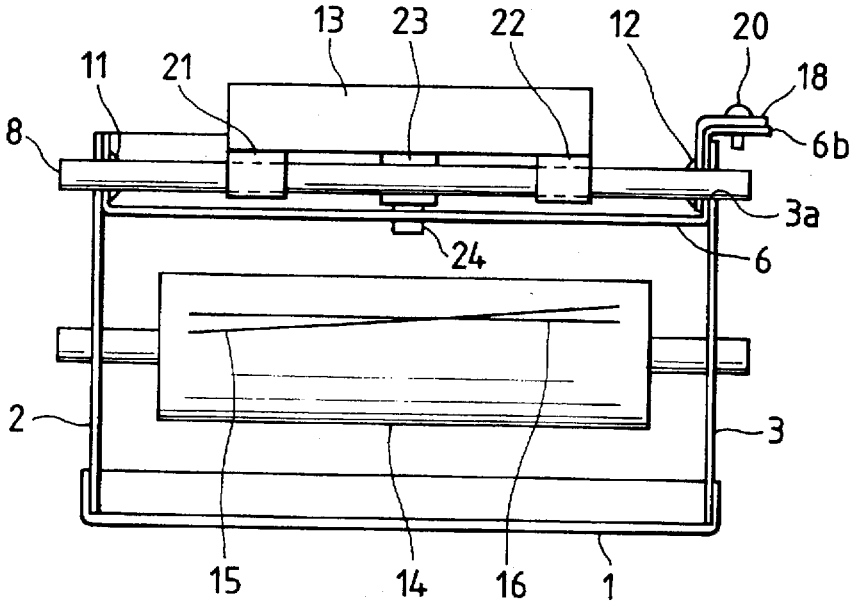
FIG. 3 is a sectional side view of the electrophotographic apparatus of the invention.

In FIGS. 1 to 3, reference numeral 1 denotes a bottom plate that forms the frame of an electrophotographic apparatus. A front plate 2 and a rear plate 3 are secured to both end portions of the bottom plate 1. A side plate 4, a side plate 5 and a top plate 6 are secured between the front plate 2 and the rear plate 3. The boxlike frame of the electrophotographic apparatus is formed in this way. It may be noted that each plate is made of, e.g., a 1.2 mm thick plated steel strip.

The upper surface of the top plate 6 is positioned slightly lower than the upper edges of the front plate 2, the rear plate 3 and the side plates 4 and 5. A first space formed by the upper surface of the top plate 6 and the respective plates 2, 3, 4 and 5 surrounding the upper surface of the top plate 6 is used as a portion for mounting an optical scanning unit 13. A second space formed by the lower surface of the top plate 6, the respective plates 2, 3, 4 and 5 surrounding the lower surface of the top plate 6, and the bottom plate 1 is used as a portion for mounting a photosensitive drum 14 serving as an image carrying body. It may be noted that the second space is used also to accommodate means required for the electrophotographic process other than the exposing unit (the optical scanning unit 13), the means including a charging unit, a developing unit, a transferring unit, a cleaning unit, a fusing unit, a means for forwarding a recording medium such as recording paper or the like, in addition to the photosensitive drum 14 (these means are not shown).

The photosensitive drum 14 is rotatably supported by the front plate 2 and the rear plate 3.

Further, in the first space, stainless steel shafts 7, 8, each having a diameter of about 10 mm and a length of about 450 mm, are supported between the front plate 2 and the rear plate 3. The shafts 7 and 8 extend in parallel with each other while interposing a predetermined distance therebetween.

The optical scanning unit 13 is supported not only by engaging recessed portions of holding members 21 and 22 with the shaft 8 and a recessed portion of a holding member 23 with the shaft 7, but also by engaging a boss 24 with a long hole 6c formed in the top plate 6. The holding members 21 and 22 are formed integrally with a lower portion of the optical scanning unit 13. Here, the engagement of the boss 24 with the long hole 6c regulates the position of the optical scanning unit 13 in the axial direction of the photosensitive drum 14. It may be noted that since the optical scanning unit 13 is usually assembled in a prototype jig that has the first space therein prearranged before being mounted onto the shafts 7, 8, any optical scanning units prepared through the assembling and adjusting processes in the prototype jig are basically considered to be adjusted consistently.

The holding member 23 has the recessed portion for guiding the optical scanning unit 13 in the horizontal directions, whereas the holding members 21, 22 have the recessed portion for positioning the optical scanning unit 13 to the shaft 8.

The top plate 6 has a long through hole 6a in a region through which a beam injected from the optical scanning unit 13 passes. A latent electrostatic image is recorded on the photosensitive drum 14 by scanning such beam.

Further, a shaft holder 18 is secured to an end portion of the shaft 8 through a welded portion 12. The shaft holder 18 has a long through hole **18*a* extending along a line indicated by arrows "a" as shown in FIG. 1. On the other hand, a projecting strip 6b provided in a part of the top plate 6 so as to confront the shaft holder 18 has a screw hole corresponding to the long through hole 18*a***.

Still further, a through hole **3*a* formed in the rear plate 3 to engage the shaft 8 is also long and extends horizontally. When the shaft holer 18 is moved along the long through hole 18*a* by loosening screws 19, 20, the shaft 8 flexes horizontally (in the directions indicated by the arrow) with a welded portion 11** as a fulcrum.

It may be noted that the other end of the shaft 8 and both ends of the shaft 7 are secured to the corresponding plates by the welded portion 11, and welded portions 9, 10.

In the aforementioned construction, the method of adjusting the inclination of a scanning line involves the steps of: measuring a displacement of a scanning line 15 with respect to a desired scanning line 16; and positioning the shaft 8 so as to coincide with the scanning line 16 by moving the shaft 8 as much as the displacement in the horizontal direction. After the positioning, the shaft 8 is fixed by tightening the screws 19 and 20.

What is important here is that the length of the shaft 8 be set to a value sufficiently larger than that of the diameter thereof and that a displacement of the shaft holder 18 be set to a small value with respect to the length of the shaft 8. As a result, the strain and stress of the welded portions 11, 12 can be suppressed to small values, which in turn allows a light and highly rigid frame to be obtained.

As described in the foregoing, the invention can provide an electrophotographic apparatus exhibiting excellent assembling performance in the sense that the adjustment of the optical scanning unit does not entail much time and labor.

Further, the invention can provide an electrophotographic apparatus exhibiting excellent maintainability in the sense that the apparatus requires no readjustment of the error in the positioning of the optical scanning unit with respect to the apparatus main body in replacing the old optical scanning unit with a new one.

Still further, the invention can improve the reliability of an electrophotographic apparatus having a frame made of sheet metal.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An electrophotographic apparatus, comprising:

an image carrying body;

an optical scanning unit; and optical scanning unit support means for pivoting said optical scanning unit in a horizontal plane parallel to a bottom surface of said electrophotographic apparatus to correct an error in positioning said image carrying body with respect to said optical scanning unit.

2. An electrophotographic apparatus according to claim 1, wherein said optical scanning unit support means comprises two shaft members and a holder member, said two shaft members being supported both parallelly and horizontally, said holder member supporting one end of at least one of said two shaft members so as to be movable in a horizontal direction; an inclination of a scanning line with respect to said image carrying body being adjustable by moving said optical scanning unit supported by said two shaft members in the horizontal direction together with said shaft member which is movable.

3. An electrophotographic apparatus according to claim 2, further comprising a casing defining first and second spaces, said first space receiving said optical scanning unit therein and said second space receiving said image carrying body therein.

4. An electrophotographic apparatus according to claim 3, wherein said casing comprises a plurality of vertical plates which support said two shaft members, and a horizontal plate which defines a boundary between said first and second spaces.

5. An electrophotographic apparatus according to claim 3, wherein the respective ends of said two shaft members except for said one end thereof being supported by said holder member are secured to said vertical plates by welding.

6. An electrophotographic apparatus according to claim 4, wherein said holder member is secured to said one end of said at least one of said two shaft members by welding.

7. A method of adjusting an inclination of a scanning line in an electrophotographic apparatus, the scanning line being scanned onto an image carrying body by an optical scanning unit supported by at least one shaft which is horizontally provided and has one end fixed and the other end movable in a horizontal direction parallel to a bottom surface of the electrophotographic apparatus, said method comprising the steps of:

measuring a horizontal displacement of an actual scanning line with respect to a desired scanning line;

moving the other end of said at least one shaft by the amount of the horizontal displacement detected in said measuring step so that the actual scanning line coincides with the desired scanning line; and fixing the position of said at least one shaft.

8. An electrophotographic apparatus comprising:

a casing;

an image carrying body inside said casing;

an optical scanning unit inside said casing for scanning an image onto said image carrying body;

at least one shaft member for supporting said optical scanning unit, wherein said at least one shaft member extends across said casing and has a first end fixedly secured to one side of said casing and a second end movably secured to an opposite side of said casing, said second end being movably secured to the opposite side of said casing in order to correct a deviation in an image being scanned by said optical scanning unit onto said image carrying body; and a shaft holder for fixing a position of said second end of said at least one shaft.

9. An electrophotographic apparatus as recited in claim 8, wherein said optical scanning unit comprises a bottom surface with holding members protruding from said bottom surface, wherein said at least one shaft member is held by said holding members.

10. An electrophotographic apparatus as recited in claim 9, wherein said holding members have substantially U-shaped openings.

11. An electrophotographic apparatus as recited in claim 10, comprising at least two shaft members, one of said shaft members being received by holding members opening in a first direction, and another one of said shaft members being received by holding members opening in a second direction which is perpendicular to said first direction.

12. An electrophotographic apparatus as recited in claim 9, further comprising:

a boss protruding from the bottom surface of said optical scanning unit; and a top plate disposed in said electrophotographic apparatus, said top plate having an elongated hole in which said boss is received.

13. An electrophotographic apparatus as recited in claim 8, wherein said first end of said at least one shaft member is welded to said one side of said casing.

14. An electrophotographic apparatus as recited in claim 8, wherein said second end of said at least one shaft member is welded to said shaft holder, and said shaft holder has an elongated through hole that is aligned with a hole in a plate extending from said opposite side of said casing.

15. An electrophotographic apparatus as recited in claim 8, wherein said first and second ends of said at least one shaft member protrude through holes in the sides of said casing.

16. An electrophotographic apparatus as recited in claim 15, wherein one of said holes in the sides of the said casing is an elongated hole.

* * * * *